United States Patent [19]

Meyer

[11] Patent Number: 4,491,328

[45] Date of Patent: Jan. 1, 1985

[54] TARGET HAVING SHIFTABLY MOVABLE TARGET STRUCTURE

[76] Inventor: Leonard S. Meyer, 6449 Bridgewood Rd., Columbia, S.C. 29206

[21] Appl. No.: 401,084

[22] Filed: Jul. 23, 1982

[51] Int. Cl.[3] ..... F41J 3/00

[52] U.S. Cl. ..... 273/403; 273/407; 273/408

[58] Field of Search ..... 273/403, 404, 407, 408, 273/409, 155, 94; 40/525

[56] References Cited

U.S. PATENT DOCUMENTS

| | | | |
|---|---|---|---|
| 1,614,583 | 1/1927 | Zimmerman | 273/155 X |
| 3,088,738 | 5/1963 | Meyer | 273/407 X |
| 3,672,674 | 6/1972 | Reed | 273/94 R |
| 3,902,721 | 9/1975 | Piccini | 273/404 |
| 4,076,246 | 2/1978 | Meyer | 273/408 |
| 4,247,116 | 1/1981 | McQuary | 273/408 X |

FOREIGN PATENT DOCUMENTS

| | | | |
|---|---|---|---|
| 1028330 | 2/1953 | France | 40/525 |
| 1101522 | 4/1955 | France | 40/525 |

*Primary Examiner*—Paul E. Shapiro

*Attorney, Agent, or Firm*—Kenneth P. Synnestvedt

[57] ABSTRACT

A target comprising missile penetrable material arranged in the form of a continuous loop, the loop being flattened to provide substantially flat front and back sides, and the target material of the loop being flexible and being shiftably movable from one portion of the loop to another portion thereof.

14 Claims, 11 Drawing Figures

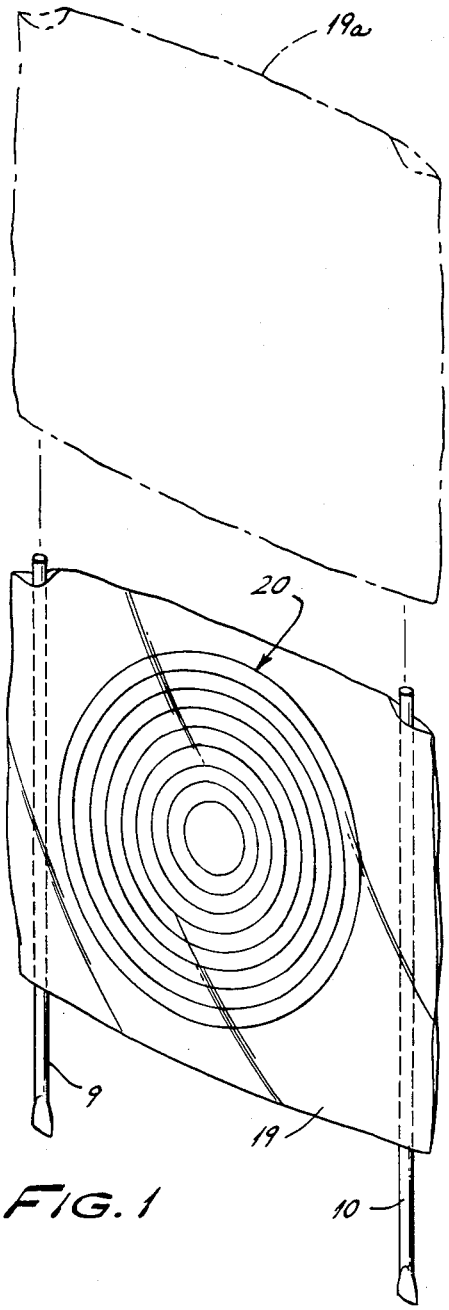
FIG. 1
FIG. 2.
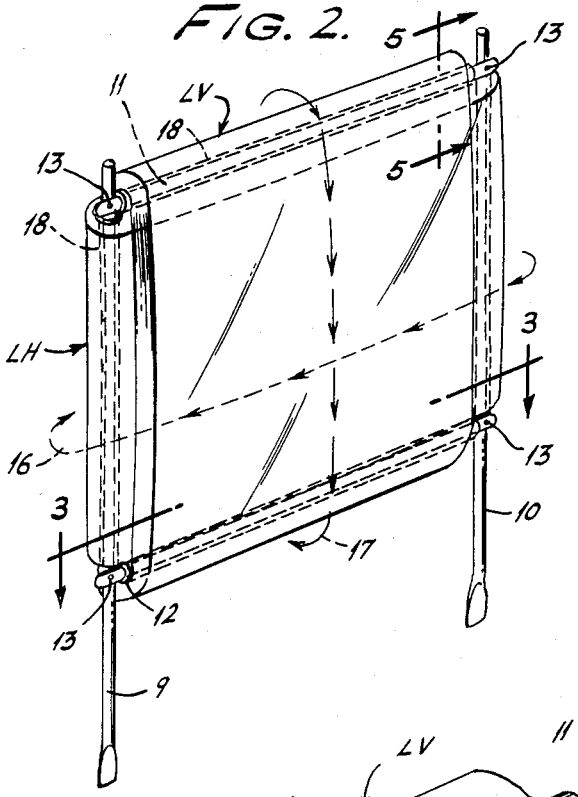
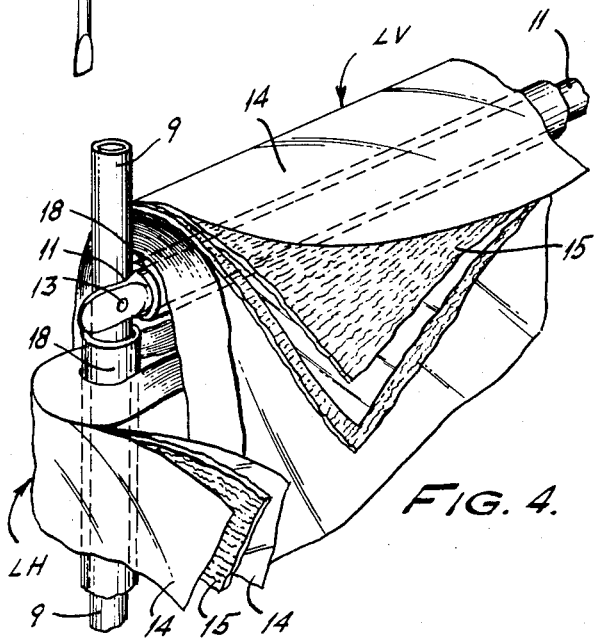
FIG. 4.
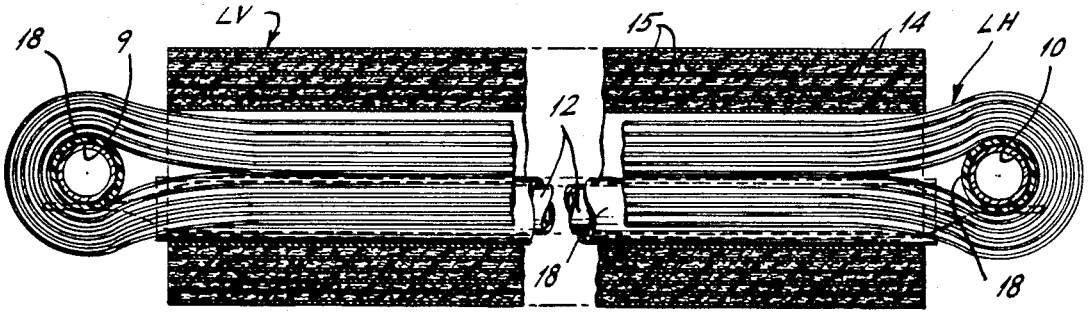
FIG. 3.

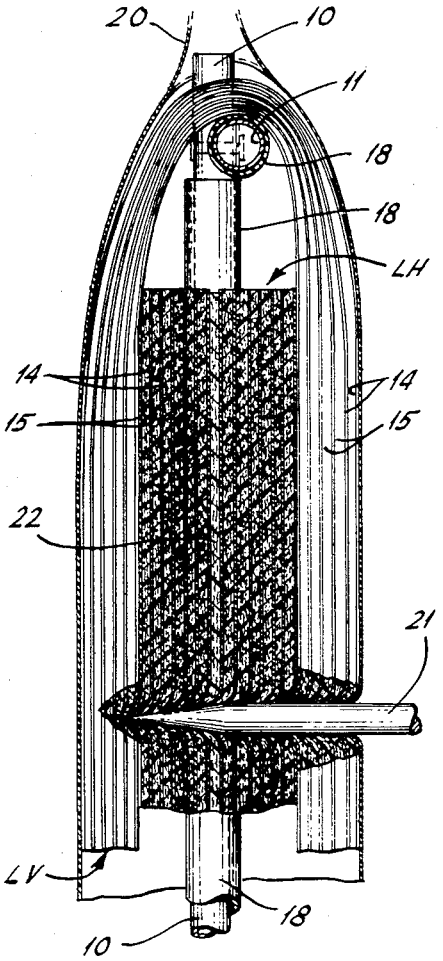
FIG. 6.
FIG. 7.
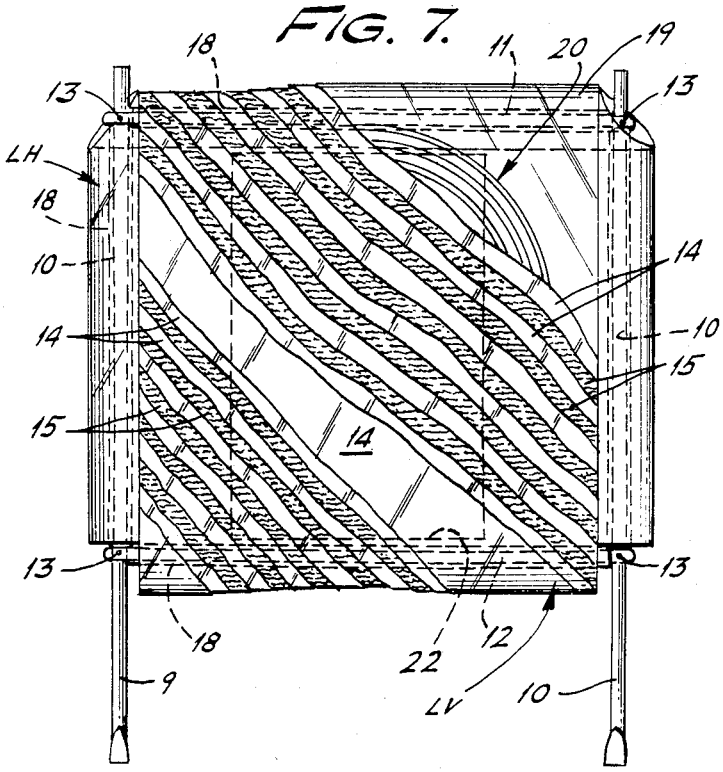
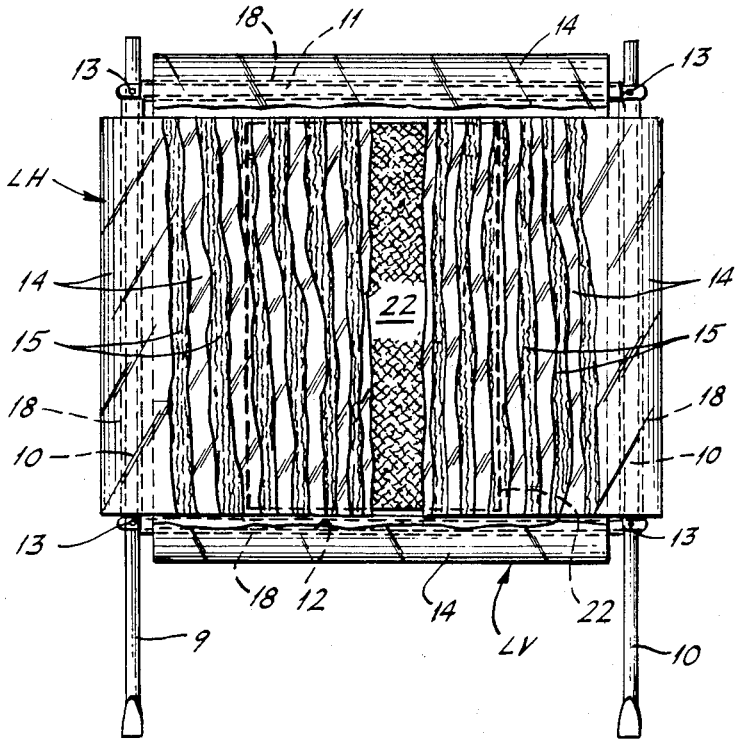
FIG. 8.

TARGET HAVING SHIFTABLY MOVABLE TARGET STRUCTURE

BACKGROUND AND STATEMENT OF OBJECTS

The present invention is concerned with a target; and while many aspects of the invention may be employed in targets provided for use with a variety of missiles, the target is particularly suitable for use as an archery target, in which connection the invention is described hereinafter.

Targets for various purposes have been made from a variety of materials. Until recent years, most archery targets were formed of straw, frequently in the form of a disk of approximately three feet in diameter. This well-known form of archery target has numerous disadvantages including heavy weight, bulkiness, and also deterioration when exposed to the weather. Moreover, targets of this prior type have a relatively short life. Scoring considerations commonly result in much more numerous strikes in the central area of the target than in the other areas, so that the central area wears and weakens quite rapidly and at a much higher rate than the other areas of the target.

Having in mind the foregoing disadvantages of the straw type of target, my prior U.S. Pat. No. 4,076,246 provides an archery target formed of a combination of multiple layers of plastic membranes and porous or foamed plastic materials, and the target of my prior patent was constructed of a multiplicity of board-like components formed of the membranes and plastic materials, the board-like components being capable of being alternatively positioned in various positions in the target face, in order to bring new target material into the central region of the target, and thereby increase the overall life of the target. With the target of my prior patent, in order to bring different board-like components into the central region of the target, it is necessary to disassemble and reassemble the target.

The present invention provides a novel system providing for shiftably moving portions of the target material from one area of the target face into another area thereof, without the necessity for disassembling and reassembling the target. The novel system of this invention provides maximum convenience and facility for effecting such shifting movements of the target material.

In a preferred embodiment according to the present invention, the target material is arranged in the form of a continuous loop or loop assembly having flattened sides providing substantially flat front and back faces for the target. The target material of which the loop is formed is flexible and is shiftably movable into different positions in the loop assembly. This provides maximum convenience in shifting the position of target material from one area of the loop assembly into another area thereof, including shifting of the target material from an area of the front face of the target to an area of the back face of the target, and vice versa.

Preferably, the target comprises at least two loop assemblies formed of the target materials and arranged in the manner above referred to, the flattened sides of one of the loops being arranged to lie between the flattened sides of the other loop assembly. It is contemplated that at least a pair of loops be arranged on axes at right angles to each other, and this further maximizes the capability of shifting different areas of the target material from one position to another in relation to the center of the target.

In accordance with another aspect of the invention, provision is made for forming the loop assemblies by helically winding turns of the sheet material employed, thereby greatly facilitating fabrication of the target, as compared with a construction requiring separate fabrication of individual board-like components.

While the loop assembly arrangement of the present invention is particularly adapted for use in connection with the type of target structure having multiple layers of membranes and intervening layers of porous material, it is to be understood that various of the features above described may be employed with target materials of other types employed not only for archery purposes but also for other purposes. However, it is preferred in accordance with the invention that the target materials be flexible, so that they can be shifted from one flat side of the loop assembly to the other flat side thereof.

BRIEF DESCRIPTION OF THE DRAWINGS

How the foregoing and other objects and advantages are attained will appear more fully from the following description and accompanying drawings, in which:

FIG. 1 is a perspective view of a target constructed in accordance with the present invention and having a cover or enclosure, this view illustrating in dot and dash lines a separation of the cover or enclosure for the target;

FIG. 2 is a perspective view of the target with the covering removed and illustrating the general arrangement of loop assmeblies employed;

FIG. 3 is a horizontal sectional view taken substantially as indicated by the line 3—3 on FIG. 2, this view being on an enlarged scale but having the central portion of the target broken out;

FIG. 4 is an enlarged fragmentary perspective view of the upper left hand corner of the target shown in FIG. 2, and with certain layers of the loop material broken away and separated in order to illustrate the construction of the target;

FIG. 6 is a view similar to FIG. 5 but illustrating a modified form of the target in which a board-like element is introduced in the central region of the flattened loops of the target;

FIGS. 7 and 8 are face views of the target of FIG. 6 but having various layers of materials broken away in order to illustrate the interior layers, as will be further explained;

FIG. 9 is a front view of the modified form of the target, with a portion of the target face removed;

FIG. 10 is a somewhat diagrammatic view of the horizontal and vertical loops of target material incorporated in the embodiment shown in FIG. 9, with the loops opened and with portions of various layers of the target material in each of the horizontal and vertical loops broken away in order to illustrate dimensional relationships; and FIG. 11 is a transverse sectional view of two layers of the target material included in the horizontal loop, this view being taken through the two illustrated layers as indicated by the section line 11—11.

DETAILED DESCRIPTION OF THE DRAWINGS

Figure 5:
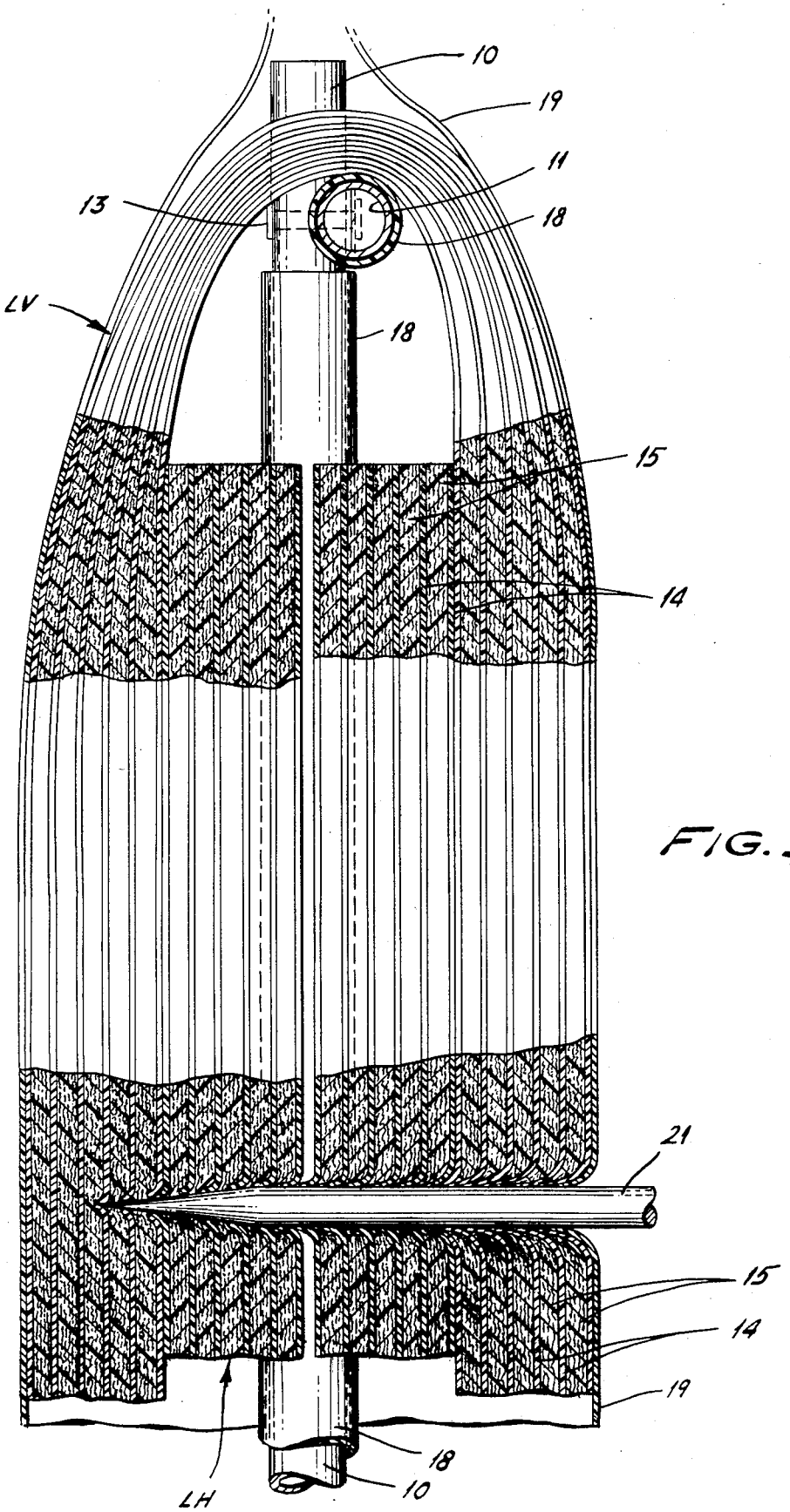
FIG. 5 is an enlarged fragmentary sectional view taken as indicated by the section line 5—5 on FIG. 2 and illustrating the action of the target upon the penetration of an arrow into the target material of the loops.

In a typical embodiment of the invention, for instance in the embodiment as illustrated in FIGS. 1 to 5 inclusive, the target is assembled or mounted on a frame structure which, in this embodiment, comprises a pair of spaced upright frame elements 9 and 10 which are interconnected by means of a pair of generally horizontal spaced and parallel frame elements 11 and 12. For purposes of convenience in assembly, shipping and the like, it is preferred that the structural elements of the supporting frame be secured to each other by means of separable fasteners at the junction points, as indicated at 13.

The target itself, which is mounted upon the frame, preferably comprises a plurality of assemblies of superimposed membranes of sheet resin material and layers of resilient and porous material interposed between and serving to interspace the membranes. Such membranes are indicated at 14, and the intervening layers of porous material are indicated at 15. The membranes and layers of porous material of each assembly are advantageously helically wound in a manner to form a loop, and the loop is flattened in order to provide substantially flat front and back faces. One such loop is horizontally arranged, as indicated generally at LH, with the ends of the loop extended around the upright structural elements 9 and 10. The other of the two loop assemblies in the embodiment of FIGS. 1 to 5 is indicated generally at LV and is helically wound and flattened, having its ends extended around the horizontal frame elements 11 and 12.

Each loop assembly is flexible and areas thereof are adapted to be moved from one position in the loop to another position, for instance in paths as indicated by arrows applied to FIG. 2. Thus, the horizontal loop LH is adapted to be moved about the vertical frame elements 9 and 10 in the manner indicated by the arrow 16; and the vertical loop LV is adapted to be moved about the horizontal frame elements 11 and 12 in the manner indicated by the arrow 17.

According to the invention, it is further contemplated that the mounting or frame structure for the target embody some form of rotative supporting devices facilitating the motion of the loops as described just above. Although such mechanism may take a veriety of forms, in the embodiment of FIGS. 1 to 5, a freely rotative tube 18 surrounds each of the upright and horizontal supporting elements 9, 10, 11 and 12. In a typical embodiment, the supporting elements 9, 10, 11 and 12 are desirably formed of metal, for instance, aluminum tubing; and the rotative tubes 18 are advantageously formed of plastic or resin material.

The assembly of the loops and portions of the supporting frame are preferably enclosed within an envelope indicated at 19 in FIG. 1, which envelope desirably is provided with a target face such as indicated at 20. This envelope may be open at the bottom to provide for convenient separation of the envelope and the remainder of the target as by upward displacement of the envelope to a position such as indicated at 19*a* in FIG. 1. Plastic sheet material is desirably employed for the envelope 19.

The loop assemblies are flexible and are readily shiftable to bring different areas of the loops into the central target area which, as brought out above, is the area which is subject to the most rapid wear.

The target may be mounted in any desired manner, for instance, by a base or standard cooperating with the upright supporting elements 9 and 10. If desired, the target may be inverted from the position shown in the drawings and may then be suspended by engagement with the vertical elements 9 and 10.

The arrangement as described above may readily be employed with any of a variety of target materials, provided they are of flexible character. However, in accordance with one preferred embodiment for the target materials, multiple layers of membranes and interspacing layers of porous material are used. Full description of preferred materials of this type is disclosed in my prior U.S. Pat. No. 4,076,246 above identified. As pointed out in that prior patent, the penetration of the leading end of an arrow shaft, as indicated at 21 in FIG. 5, results in piercing of the membranes and the formation of a collar or sleeve around each membrane aperture, which collar applies drag to the arrow and thereby absorbs the energy of the arrow's motion. The layers of porous material 15 lying between the membranes permits the formation of the collars or sleeves in the manner which will be clear from examination of FIG. 5. The action of the collars to arrest the motion of the arrow will continue even when the arrow passes all the way through the target material and projects at the rear face of the target; and for this reason, it is preferred that the back side of the target be left open or unobstructed so as not to interfere with the projection of arrows from the rear face of the target material.

It is to be understood that the target material employed in the formation of the loop assemblies should be flexible in order to provide for shifting movement of different areas of the loop into the centeral region of the target face. A wide variety of materials may be employed; but in accordance with a preferred embodiment, the materials utilized are advantageously of the kind referred to in my prior U.S. Pat. No. 4,076,246 above referred to. Thus, the sheets or films employed to form the membranes may desirably be formed of polyethylene or some other material which is penetrable, elastomeric or resilient, and tear-resistant. Thus, films formed of nylon, vinylidene chloride or plasticized polyvinyl chloride may be employed. In all cases, the materials are preferably self-healing or recoverable.

Materials of the kind referred to above for use in forming the membranes may advantageously be of a thickness of the order of 0.004 inch (0.1 mm).

A wide variety of materials may also be employed for the porous or foam spacers employed between the membranes. For example, foamed low-density polyethylene or polyolefin, such as polypropylene. A typical thickness for the foam spacer usable in an embodiment of this type would be of the order of one-sixteenth inch (1.5 mm), and the material would desirably be of the order of 1.0 lbs. per cubic foot (0.016 gr. per cubic cm). Other foam materials may be employed including polyethylene foam, flexible urethane foam, or even low-density mats formed of curled hair, cellulose or fiber glass.

Turning now to the embodiment of the target illustrated in FIGS. 6, 7 and 8, it is first pointed out that most of the components are the same as previously described; and in these figures, the same reference characters have been employed to identify the corresponding parts.

However, in FIGS. 6, 7 and 8, the target further includes insertion of a central target board indicated at 22. This board may be formed of any of a variety of materials and need not necessarily be of the same flexibility as the loop assemblies. The board is desirably positioned between the flattened sides of the interior loop assembly LH. The board 22, as clearly indicated in FIGS. 7 and 8, need not necessarily be of full width or height, but may be of reduced size, corresponding to only the central portion of the target area. Such a board may be formed, for example, of nylon, polyester, or Kevlar (Dupont) felts bonded either adhesively or mechanically. The board will supplement the action of the other target materials in arresting the motion of the arrow, and the board can readily be replaced, if desired; and this may also assist in providing for increased overall life of the target as a whole.

Other materials may be employed for the replaceable board insert, for instance, loosely bonded long fiber batting.

Various layers of the materials used in the loop assemblies have been broken away in FIGS. 7 and 8 in order to disclose layers lying in the interior, including the board 22. In FIG. 7, a portion of the enclosing envelope 19 appears at the top right corner; and in FIG. 8, the enclosing envelope has been completely removed. In FIG. 8, the entire front side of the outer loop LV has been broken away, and individual layers of the front side of the inner loop LH have been broken away toward both sides of the target, thereby exposing a central portion of the board 22.

As above mentioned, the central board 22 may be of width smaller than the overall width of the loops. Moreover, selected layers of the loops themselves may similarly be of lesser width than the overall width of the loops, thereby concentrating the target material of the loops in the central region of the target.

Figure 9:
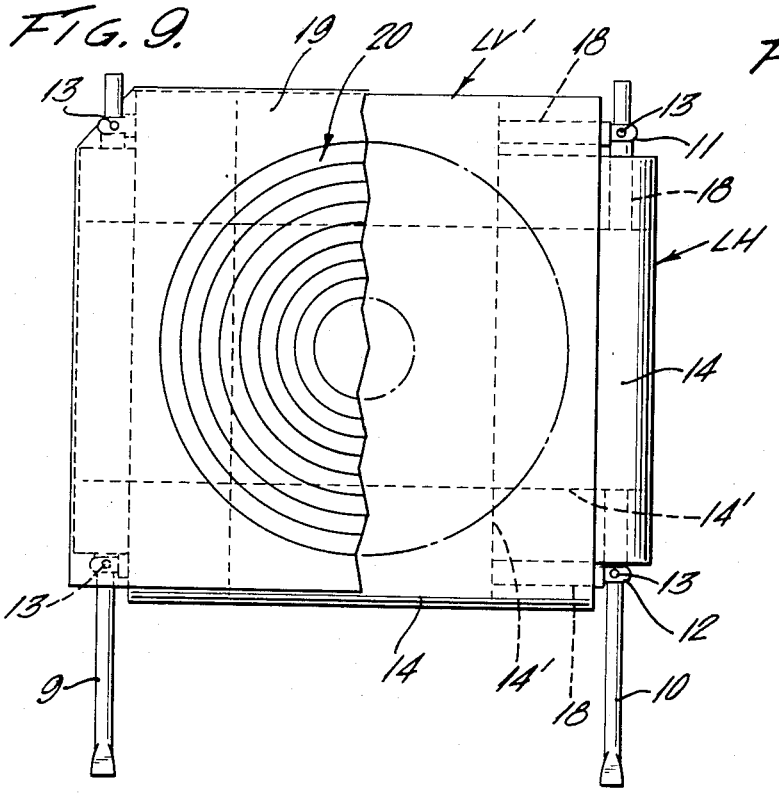
FIGS. 9, 10 and 11 are views of another embodiment of the target, briefly described as follows.
Figure 11:
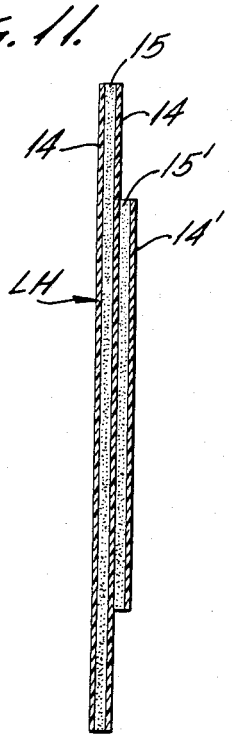
Figure 10:
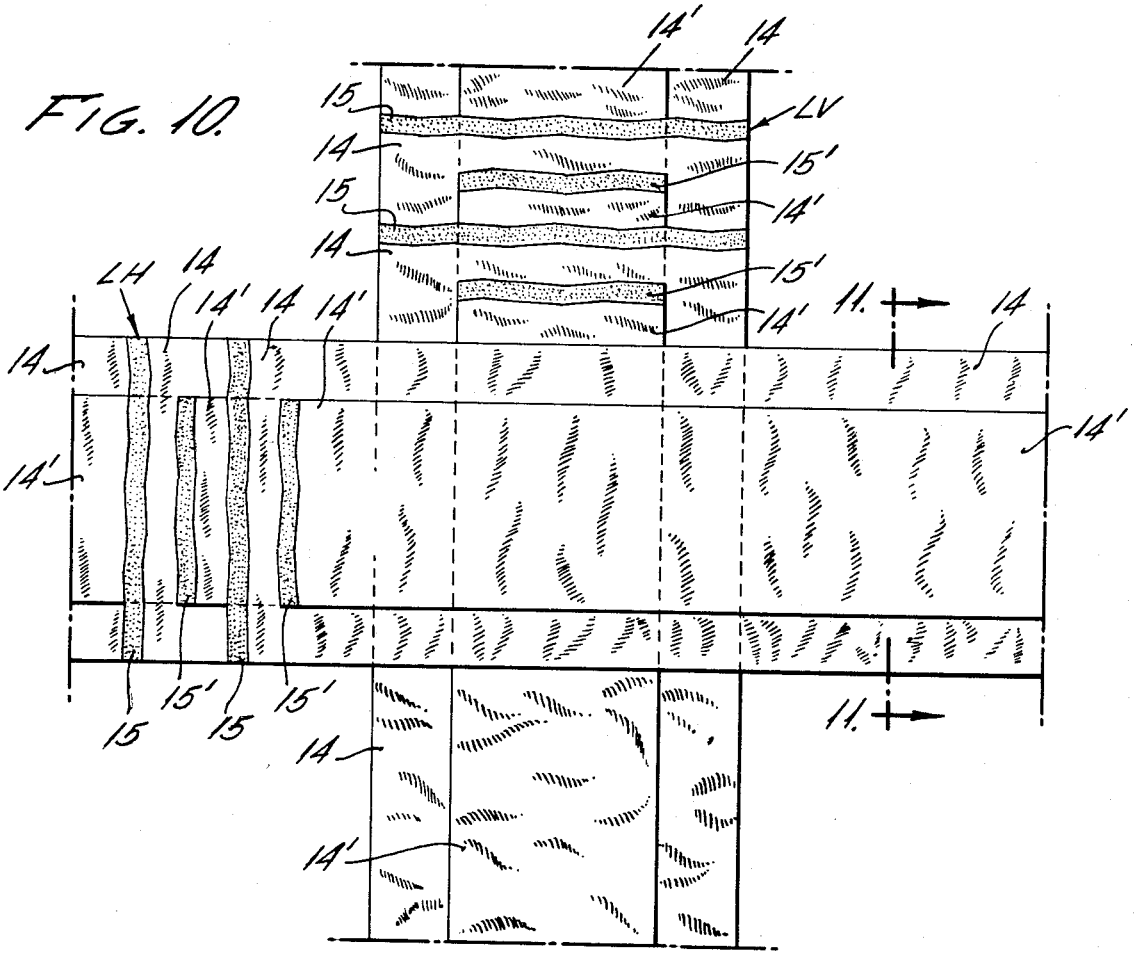

As mentioned just above, selected layers of the loops of target materials may be of lesser width than the overall width of the loops; and this is illustrated in the embodiment shown in FIGS. 9, 10 and 11. In these views, the same reference numerals have been applied as in other embodiments wherever the parts are identical.

It will be observed that for purpose of illustration, in FIG. 10 each of the loops are shown as having been transversely split, in the middle of the back side of each of the two loops; and the split loops have been unfolded or flattened for purposes of illustration. Portions of the layers near the split line have been broken away in order to show the differences in width of various layers.

Examination of all three of FIGS. 9, 10 and 11 will show that in each loop cerain of the layers are of the same width as the layers of the loops shown in the earlier embodiments, and these portions of the layers are indicated by the same reference numerals, namely, reference numeral 14 for the plastic membranes, and reference numeral 15 for the intervening layers of porous material. However, as will be seen from FIGS. 9, 10 and 11, alternate layers of the plastic membranes and porous layers are identified respectively by the reference numerals 14' and 15', and these alternate layers are of smaller width than the layers 14 and 15. This clearly appears in FIGS. 9, 10 and 11 from which it will be seen that the strips of narrower width are located in the central region of the horizontal and vertical loops.

Because of the arrangement just described, the essential target material employed in the target as a whole is concentrated in the central region of the target, as is the case with the embodiment of FIGS. 6, 7 and 8 in which a central target board 22 is employed, thereby providing for increased overall life of the target as a whole as is brought out above in connection with FIGS. 6, 7 and 8.

I claim:

1. An archery target comprising an assembly of superimposed membranes of sheet resin material, and a multiplicity of layers of resilient and porous material interposed between and each serving to interspace at least a plurality of the membranes, the membranes and layers comprising continuous loops and the loops being flattened to provide a loop assembly having a substantially flat front face and a substantially flat back face, the membranes being penetrable by an arrow cast at the face and being resilient and tear resistant, and the layers of resilient and porous material being penetrable by an arrow cast at the target and providing freedom for formation of sleeve shaped portions of the membranes engaging the arrow around the penetration apertures to provide for imposition of frictional drag in a plurality of zones along the shaft of an arrow penetrating the target and also for partial recovery of withdrawal of the arrow, and the assembly of membranes being shiftably movable to different positions in said loop assembly, said loops comprising helically wound turns of a group of webs in face-to-face relation and including at least one web of said sheet resin material and at least one web of said resilient and porous material.

2. An archery target comprising an assembly of superimposed membranes of sheet resin material, and a multiplicity of layers of resilient and porous material interposed between and each serving to interspace at least a plurality of the membranes, the membranes and layers comprising continuous loops and the loops being flattened to provide a loop assembly having a substantially flat front face and a substantially flat back face, the membranes being penetrable by an arrow cast at the face and being resilient and tear resistant, and the layers of resilient and porous material being penetrable by an arrow cast at the target and providing freedom for formation of sleeve shaped portions of the membranes engaging the arrow around the penetration apertures to provide for imposition of frictional drag in a plurality of zones along the shaft of an arrow penetrating the target and also for partial recovery of withdrawal of the arrow, and the assembly of membranes being shiftably movable to different positions in said loop assembly, the target comprising at least two of said flattened loop assemblies with their axes at an angle to each other and with one of said loop assemblies positioned within the loop of the other.

3. An archery target comprising an assembly of superimposed membranes of sheet resin material, and a multiplicity of layers of resilient and porous material interposed between and each serving to interspace at least a plurality of the membranes, the membranes and layers comprising continuous loops and the loops being flattened to provide a loop assembly having a substantially flat front face and a substantially flat back face, the membranes being penetrable by an arrow cast at the face and being resilient and tear resistant, and the layers of resilient and porous material being penetrable by an arrow cast at the target and providing freedom for formation of sleeve shaped portions of the membranes engaging the arrow around the penetration apertures to provide for imposition of frictional drag in a plurality of zones along the shaft of an arrow penetrating the target and also for partial recovery of withdrawal of the arrow, and the assembly of membranes being shiftably movable to different positions in said loop assembly, the target further including a panel formed of target-penetrable material, the panel being positioned within the loop between the substantially flat front and back faces of the loop.

4. An archery target comprising an assembly of superimposed membranes of sheet resin material, and a multiplicity of layers of resilient and porous material interposed between and each serving to interspace at least a plurality of the membranes, the membranes and layers comprising continuous loops and the loops being flattened to provide a loop assembly having a substantially flat front face and a substantially flat back face, the membranes being penetrable by an arrow cast at the face and being resilient and tear resistant, and the layers of resilient and porous material being penetrable by an arrow cast at the target and providing freedom for formation of sleeve shaped portions of the membranes engaging the arrow around the penetration apertures to provide for imposition of frictional drag in a plurality of zones along the shaft of an arrow penetrating the target and also for partial recovery of withdrawal of the arrow, and the assembly of membranes being shiftably movable to different positions in said loop assembly, some of the membranes of sheet resin material and some of the layers of resilient and porous material being of smaller width than others of said membranes and layers, and the membranes and layers of smaller width being positioned intermediate the edges of said loops, to provide an increased total number of layers in the central region of the loops as compared with the edge regions of the loops.

5. A target comprising a continuous loop of missile-penetrable target material, the loop being flattened to provide substantially flat sides forming a substantially flat front face and a substantially flat back face, the missile-penetrable target material being flexible and being shiftably movable from a position at one face of the loop to a position at the other face of the loop, the target including a plurality of loops of said missile-penetrable material, the loops being positioned at an angle to each other with the flat sides of one loop extended between the flat sides of the other.

6. A target comprising a continuous loop of missile-penetrable target material, the loop being flattened to provide substantially flat sides forming a substantially flat front face and a substantially flat back face, the missile-penetrable target material being flexible and being shiftably movable from a position at one face of the loop to a position at the other face of the loop, the target further including a panel formed of missile-penetrable material, the panel being positioned within the loop between the substantially flat sides of the loop.

7. A target comprising a continuous loop of missile-penetrable target material, the loop being flattened to provide substantially flat sides forming a substantially flat front face and a substantially flat back face, the missile-penetrable target material being flexible and being shiftably movable from a position at one face of the loop to a position at the other face of the loop, the loop of missile-penetrable material comprising a plurality of webs of material and some of the webs of material being of smaller width than others of said webs, and said webs of smaller width being positioned intermediate the edges of the loop, to provide an increased total number of webs in the central region of the loop as compared with the edge regions of the loop.

8. A target comprising structural elements interconnected to provide a centrally open frame with pairs of parallel elements at different sides of the frame, a continuous loop of missile-penetrable material extended around a parallel pair of said elements, the sides of the loop overlying the central opening of the frame being substantially flat to provide substantially flat front and back faces, and the material of said loop being flexible and shiftable to different positions circumferentially of the loop, the target further comprising at least two continuous loops of missile-penetrable material with their axes at an angle to each other and each extended around a different pair of said frame elements.

9. An archery target comprising a pair of parallel spaced generally vertical frame elements and a pair of parallel spaced generally horizontal frame elements connected with the upright elements, the upright elements being extended vertically beyond at least one of the horizontal elements, and assemblies of face-to-face superimposed webs of target material in the form of a continuous loop extended around the pairs of vertical and horizontal frame elements, each loop assembly being flattened and one of the loop assemblies being positioned at least in large part within the other, and the webs of target material being flexible and each loop assembly being shiftably movable to bring different areas thereof into the flattened area of its loop at either side of the frame.

10. A target as defined in claim 9 and further including a replaceable panel of target material positioned within the inner loop assembly between the pairs of parallel frame elements.

11. A target as defined in claim 9 in which each of the loop assemblies comprises an assembly of superimposed membranes of sheet resin material and a multiplicity of layers of resilient and porous material interposed between and each serving to interspace at least a plurality of membranes.

12. A target as defined in claim 9 and further including a covering envelope enclosing the loop assemblies and having a target face positioned to be displayed at one of the flattened sides of the loop assemblies.

13. A target comprising a continuous loop of missile-penetrable target material, the loop being flattened to provide substantially flat sides forming a substantially flat front face and a substantially flat back face, and a pair of spaced parallel target supports comprising rotative elements positioned within and engaging the ends of the loop, the target material of the loop being flexible and being shiftably movable around end portions of the loop in engagement with said rotative elements, the target comprising two continuous loops of the missile-penetrable target material with the axes of the loops arranged at an angle to each other, and the target comprising separate rotative elements for each loop arranged within and engaging the ends of the loop.

14. A target comprising a continuous loop of an assembly of face-to-face superimposed webs of target material, the loop being flattened to provide substantially flat sides forming a substantially flat front face and a substantially flat back face, some of the webs being of lesser width than other webs and being positioned in the central region of the loop, the target material of the webs being flexible and being shiftably movable around end portions of the loop.

* * * * *